US007817957B2

(12) United States Patent
Oohara et al.

(10) Patent No.: US 7,817,957 B2
(45) Date of Patent: Oct. 19, 2010

(54) DOUBLE FEED SENSING DEVICE, DOUBLE FEED DETERMINING METHOD AND IMAGE FORMING APPARATUS

(75) Inventors: Shunichi Oohara, Hitachinaka (JP); Kunio Satou, Hitachinaka (JP); Masuo Furutono, Hitachinaka (JP)

(73) Assignee: Ricoh Company, Ltd., Tokyo (JP)

( * ) Notice: Subject to any disclaimer, the term of this patent is extended or adjusted under 35 U.S.C. 154(b) by 1135 days.

(21) Appl. No.: 11/482,918

(22) Filed: Jul. 10, 2006

(65) Prior Publication Data

US 2007/0018383 A1 Jan. 25, 2007

(30) Foreign Application Priority Data

Jul. 8, 2005 (JP) ..... 2005-200073

(51) Int. Cl.
*G03G 15/00* (2006.01)

(52) U.S. Cl. ..... 399/388; 399/389; 271/258.01; 271/262; 271/263; 271/265.01; 271/265.02; 271/265.04

(58) Field of Classification Search ..... 399/388, 399/389; 271/262, 263, 258.01, 265.01, 271/265.02, 265.04

See application file for complete search history.

(56) References Cited

U.S. PATENT DOCUMENTS

2005/0058480 A1 * 3/2005 Ohashi et al. ..... 400/55

FOREIGN PATENT DOCUMENTS

| | | | |
|---|---|---|---|
| JP | 05014640 A | * | 1/1993 |
| JP | 6-40604 A | | 2/1994 |
| JP | 11-116101 A | | 4/1999 |
| JP | 2004237699 A | * | 8/2004 |

* cited by examiner

*Primary Examiner*—Ren Yan
*Assistant Examiner*—Andy L Pham
(74) *Attorney, Agent, or Firm*—Crowell & Moring LLP

(57) ABSTRACT

The invention provides a double feed sensing device capable of sensing double feed of paper sent out for the first time. The double feed sensing device includes a thickness sensing unit for sensing thickness of cut paper conveyed, a rigidity sensing unit for sensing bending rigidity of the conveyed paper, and a double feed determining unit for comparing a value of the thickness of the paper sensed by the thickness sensing unit and a value of the bending rigidity of the paper sensed by the rigidity sensing unit with threshold values of thickness and rigidity of the paper set based on values of thickness and bending rigidity of one sheet of the paper and values of thickness and bending rigidity of stacked sheets of the paper, so as to determine whether the paper is double-fed or not.

15 Claims, 6 Drawing Sheets

DOUBLE FEED SENSING DEVICE, DOUBLE FEED DETERMINING METHOD AND IMAGE FORMING APPARATUS

FIELD OF THE INVENTION

The present invention relates to a double feed sensing device for sensing double feed of cut sheets of paper (hereinafter referred to as paper simply) cut into a predetermined size, a double feed determining method and an image forming apparatus including the paper double feed sensing device.

DESCRIPTION OF THE BACKGROUND ART

In the background art, as a paper double feed sensing device in a paper conveyance apparatus for conveying paper, there has been proposed a device in which the number of sheets of paper stacked in a paper stacking portion and then sent out therefrom is counted, the thickness of one sheet is obtained from the counted number of sheets and the change of height of stacked sheets of the paper, and a threshold value of the thickness is obtained. When the thickness of the paper measured on a paper conveyance path is thicker than the threshold value, the device regards the paper as double-fed.

(JP-A-06-040604)

There has been proposed another device in which the thickness of paper stacked in a paper stacking portion is measured when the paper is sent out, and a value of the average thickness is obtained and stored. When the thickness of paper measured thereafter is thicker than the stored value of the average thickness, the other device regards the paper as double-fed.

(JP-A-11-116101)

In the paper double feed sensing device disclosed in JP-A-06-040604, the number of sheets of paper stacked in a paper stacking portion and then sent out therefrom is counted. The thickness of one sheet of the paper is obtained from the counted number of sheets and a change of the height of the stacked paper, and a threshold value of the thickness is determined. Based on the threshold value, double feed is determined. It is therefore impossible to determine whether the paper sent out from the paper stacking portion for the first time has been double-fed or not.

In addition, the thickness of one sheet of the paper is obtained from the change of height of the stacked paper. It is therefore difficult to measure a change of the thickness corresponding to a few sheets accurately from the height of several hundreds of stacked sheets of the paper. It is therefore impossible to judge double feed correctly.

On the other hand, in the background art disclosed in JP-A-11-116101, the thickness of one sheet of paper stacked in a paper stacking portion is measured when the paper is sent out. An average value of the thickness is obtained and stored. When the paper thickness measured thereafter is thicker than the stored value, it is determined that the paper has been double-fed. Also in this case, it is difficult to determine whether the paper sent out for the first time has been double-fed or not.

Further, these paper double feed sensing devices cannot judge double feed correctly when sheets of paper different in thickness are mixed in the paper stacking portion.

SUMMARY OF THE INVENTION

In order to solve the foregoing problems belonging to the background art, an object of the present invention is to provide a double feed sensing device, a double feed determining method and an image forming apparatus capable of sensing double feed surely even when paper is sent out for the first time, and sensing double feed surely even when sheets of paper different in thickness are mixed.

In order to attain the foregoing objects, according to a first configuration of the present invention, there is provided a double feed sensing device including: a thickness sensing unit for sensing thickness of cut paper conveyed; a rigidity sensing unit for sensing bending rigidity of the conveyed paper; and a double feed determining unit for comparing a value of the thickness of the paper sensed by the thickness sensing unit and a value of the bending rigidity of the paper sensed by the rigidity sensing unit with threshold values of thickness and rigidity of the paper set based on values of thickness and bending rigidity of one sheet of the paper and values of thickness and bending rigidity of stacked sheets of the paper, so as to determine whether the paper is double-fed or not.

According to a second configuration of the present invention, in the double feed sensing device defined in the first configuration, the thickness sensing unit includes a driving roller capable of rotating, a driven roller in press contact with the driving roller, and a displacement sensing unit for sensing a displacement of a shaft of the driven roller with respect to a shaft of the driving roller when the paper is held between the driven roller and the driving roller.

According to a third configuration of the present invention, in the double feed sensing device defined in the second configuration, the displacement sensing unit includes a lever capable of pivoting while supporting the driven roller at one end thereof, and the displacement sensing unit senses the displacement of the shaft of the driven roller with respect to the shaft of the driving roller based on a displacement of the other end of the lever.

According to a fourth configuration of the present invention, in the double feed sensing device defined in the third configuration, a distance L1 between a pivoting fulcrum of the lever and a point where the driven roller is supported is shorter than a distance L2 between the pivoting fulcrum of the lever and a sensing portion where the displacement of the other end of the lever is sensed.

According to a fifth configuration of the present invention, in the double feed sensing device defined in the second configuration, the rigidity sensing unit is attached to a rotating shaft of the driving roller.

According to a sixth configuration of the present invention, in the double feed sensing device defined in the first or fifth configuration, the rigidity sensing unit includes a sensing member supported so that the sensing member pivots when a front end of the paper abuts against the sensing member, an elastic member for elastically urging a part of the sensing member to appear on a conveyance path of the paper, and a displacement sensing unit for sensing a pivotal displacement of the sensing member when the paper abuts against the part of the sensing member so as to be bent.

According to a seventh configuration of the present invention, in the double feed sensing device defined in the sixth configuration, the sensing member has a first arm portion and a second arm portion integrally, the front end of the paper abutting against the first arm portion, the second arm portion having a sensing portion for sensing the pivotal displacement by means of the displacement sensing unit, and a distance L3 between a position where the front end of the paper abuts against the first arm portion and the pivoting fulcrum is shorter than a distance L4 between the sensing portion and the pivoting fulcrum.

According to an eighth configuration of the present invention, there is provided a double feed determining method including the steps of: using a thickness sensing unit to sense thickness of cut paper which is being conveyed; using a rigidity sensing unit to sense bending rigidity of the paper which is being conveyed; and using a double feed determining unit to determine double feed of the paper; wherein: threshold values of the thickness and the bending rigidity of the paper are set based on values of thickness and bending rigidity of one sheet of the paper and values of thickness and bending rigidity of stacked sheets of the paper, and stored in a storage portion of the double feed determining unit; and a value of the thickness of the paper sensed by the thickness sensing unit and a value of the bending rigidity of the paper sensed by the rigidity sensing unit are input to the double feed determining unit and compared with the threshold values respectively so as to determine existence of double feed of the paper.

According to a ninth configuration of the present invention, there is provided an image forming apparatus including: a photoconductor; an exposure unit for forming an electrostatic latent image on the photoconductor; a development unit for forming a toner image on the photoconductor; a paper stacking portion where cut sheets of paper are stacked; a conveyance mechanism for sending out the paper from the paper stacking portion toward the photoconductor; a transfer unit for transferring the toner image on the photoconductor to the paper; a fixation unit for fixing the transferred toner image to the paper; and a double feed sensing device according to any one of the first through seventh configurations, provided on a paper-conveyance-direction upstream side of the transfer unit.

According to a tenth configuration of the present invention, the image forming apparatus defined in the ninth configuration further includes a double-fed paper retracting portion for retracting the paper regarded as double-fed by the double feed sensing device.

According to the present invention, it is possible to sense double feed even when paper is sent out for the first time. In addition, even when sheets of paper different in thickness are mixed in the paper stacking portion, double feed can be sensed surely. Thus, troubles of the device caused by double feed, such as paper jam, paper winding on the conveyance roller, unfixed toner in printing, etc. can be prevented from occurring. The burden on an operator can be reduced. In the image forming apparatus, the efficiency in printing can be improved.

DETAILED DESCRIPTION OF THE INVENTION

In the present invention, the following facts have been cleared up. That is, one sheet of paper has different bending rigidity from that of two or more stacked sheets of paper. The bending rigidity of one thick sheet of paper is different from that of a compound sheet formed out of thin sheets of paper though the thickness of the former is equal to that of the latter. In a paper conveyance apparatus, the thickness of paper and the bending rigidity thereof are sensed so that it can be determined easily and properly whether paper is being single-fed or paper is being doubled-fed.

That is, the thickness of one sheet of paper and the bending rigidity thereof are measured, and the thickness of two or more sheets of paper and the bending rigidity thereof are measured. From these measured values, threshold values of paper thickness and bending rigidity are set in advance as criteria for double feed. The thickness and bending rigidity of paper conveyed actually are sensed in a paper conveyance path, and the sensed data are compared with the threshold values. Thus, it is determined whether the paper is double-fed or not.

Figure 1:
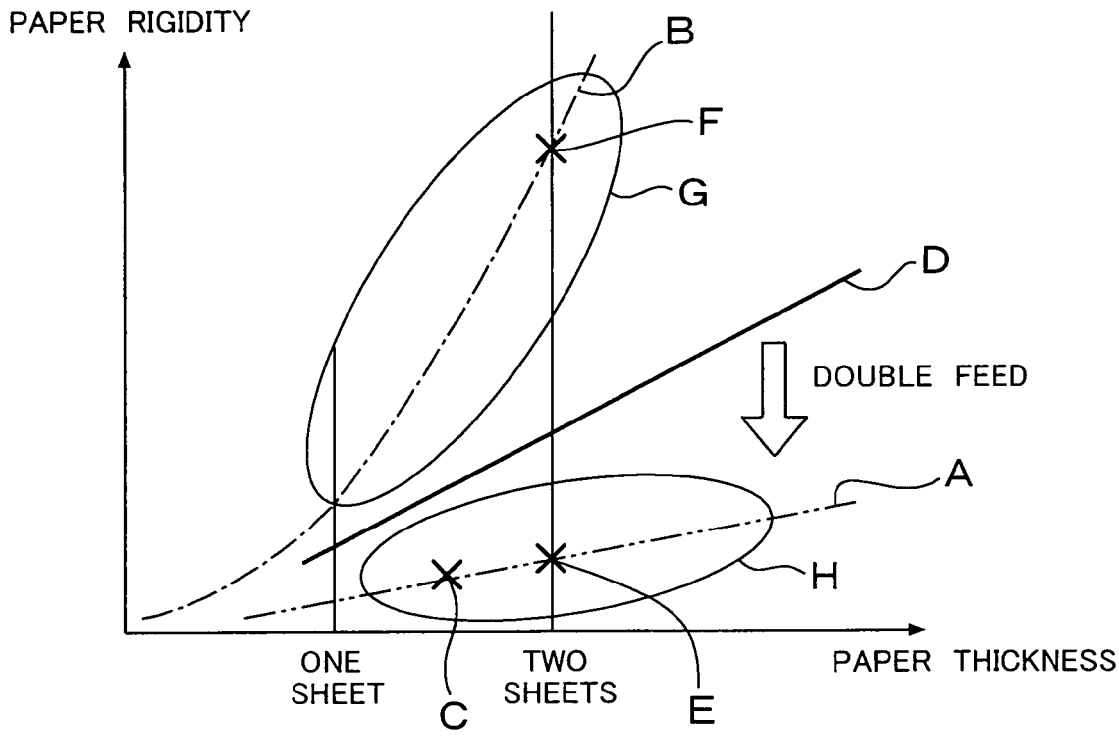
FIG. 1 is a conceptual graph showing the relationship between the thickness of paper and the bending rigidity thereof.

FIG. 1 is a conceptual graph showing the relationship between the thickness of paper and the rigidity thereof. A straight line A in FIG. 1 designates a change of bending rigidity when the thickness of the paper is changed by stacking two sheets of paper. A curve B shows a change of bending rigidity when the thickness of one sheet of paper is changed.

As is apparent from FIG. 1, it has been proved from the straight line A that the rigidity of two sheets is about twice as high as the rigidity of one sheet, and the rigidity of the two sheets increases substantially in proportion to the number of stacked sheets. It has been also proved from the curve B that when one sheet of paper having a varied thickness is used, the rigidity increases substantially in proportion to the cube of the thickness.

There is a difference in change of bending rigidity as described above. When sheets of paper having one and the same thickness are conveyed, a threshold value as criterion is set in an intermediate region, for example, in a point C, between the thickness of one sheet and the thickness of two sheets. Sensed values of the thickness and bending rigidity of paper are compared with the threshold value. When the sensed values are not larger than the threshold value, it can be determined that paper is single-fed. Otherwise it can be determined that paper is double-fed.

A threshold line D of paper thickness and bending rigidity is set in an intermediate region between a straight line A and a curve B. Paper thickness and bending rigidity are sensed. When the intersection of the sensed value of the paper thickness and the sensed value of the bending rigidity is located above the threshold line D, for example, in a point F in FIG. 1, it is determined that the paper is single-fed. When the intersection is located below the threshold line D, for example, in a point E in FIG. 1, it is determined that the paper is double-fed.

A region G and a region H in FIG. 1 designate fluctuation margins of bending rigidity as to one sheet of paper and stacked sheets respectively, where the material of the paper or a variation of measurements are taken into consideration. The threshold line D is set in consideration of these fluctuation margins, that is, not to enter each region G, H.

The threshold value C and the threshold line D are set for each kind of paper to be used, and stored in a storage portion of a double feed determining unit in advance. Determination can be made based on those stored data.

In the present invention, it is necessary to measure thickness and bending rigidity of conveyed paper in the process where the paper is conveyed. A known measuring method can be used for measuring the thickness and rigidity of the paper. As for the thickness of the paper, a driving roller for conveying the paper and a driven roller brought into press contact with the driving roller can be used. When the distance between the shafts of the two rollers is monitored, the thickness of the paper can be measured more easily.

Accurate measurement can be made particularly according to the method for measuring the distance between the shafts, where a displacement of the other end of a lever capable of pivoting is monitored while the driven roller is supported on one end of the lever.

The bending rigidity of the paper can be measured properly in the following simple configuration. That is, a sensing member is provided to abut against the front end of conveyed paper. The sensing member is urged by an elastic member so as to pivot in a direction where the sensing member can bend the front end of the paper. When the paper is bent by the sensing member, the pivotal displacement of the sensing member is sensed.

The thickness and bending rigidity of the paper may be measured in the following simplified structure with a reduced number of parts. That is, a driving roller for conveying the paper and a driven roller brought into press contact with the driving roller are provided. The thickness sensing unit is attached to the driven roller, and the rigidity sensing unit is attached to the rotating shaft of the driving roller.

Figure 2:
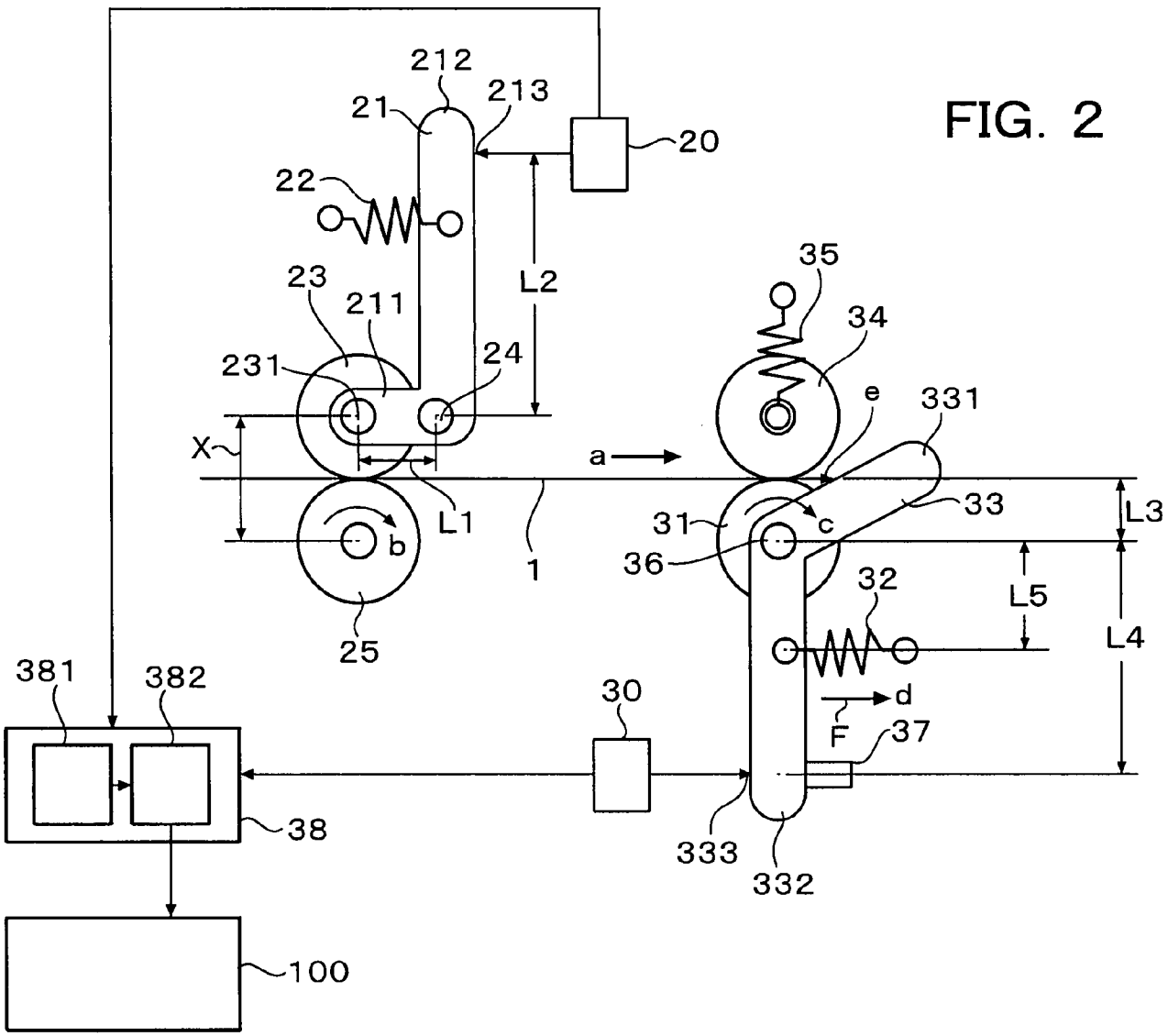
FIG. 2 is a schematic view showing the configuration of a double feed sensing device according to a first embodiment of the present invention.

Next, the double feed sensing device according to an embodiment of the present invention will be described below with reference to the drawings. FIG. 2 is a schematic configuration view of the double feed sensing device according to a first embodiment.

As shown in FIG. 2, a sensing roller 23 is disposed movably up/down with respect to a conveyance roller 25 supported in a fixed position. The sensing roller 23 is attached to a front end of an arm portion 211 of an L-shaped thickness sensing lever 21 through a spindle 231. The sensing lever 21 is supported pivotally by a spindle 24. A spring 22 is connected to the middle of an arm portion 212 of the sensing lever 21 so that the sensing roller 23 is pressed onto the conveyance roller 25 by the pulling force of the spring 22. The conveyance roller 25 is rotated in the arrow b direction by a not-shown motor (driving unit), so as to pinch paper 1 between the sensing roller 23 and the conveyance roller 25 and convey the paper 1 in the arrow a direction. Thus, the conveyance roller 25 serves as a driving roller, and the sensing roller 23 serves as a driven roller.

Figure 3:
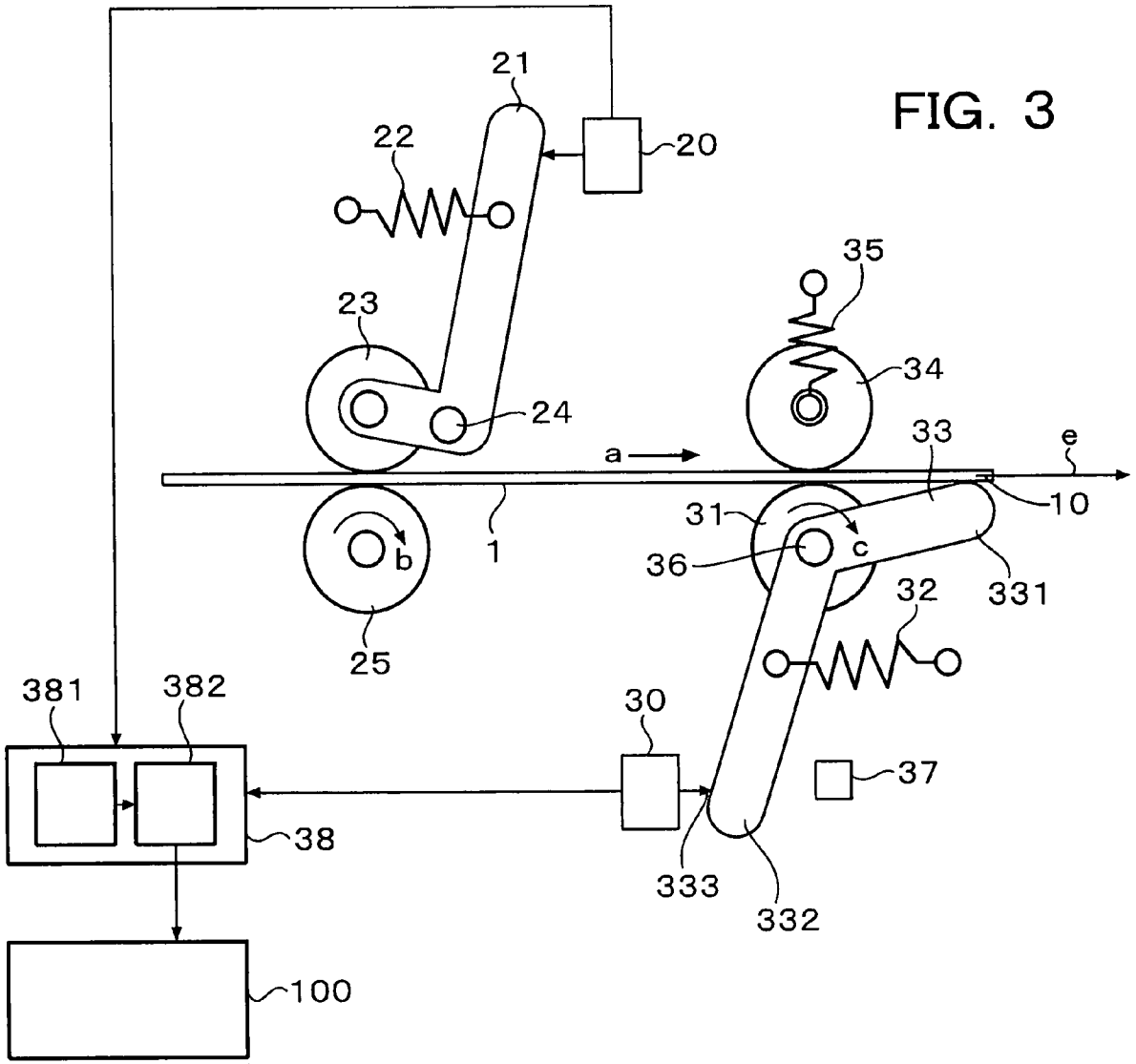
FIG. 3 is a schematic view showing the sensing operation of the double feed sensing device.

The position of the conveyance roller 25 is fixed, while the sensing roller 23 is supported by the pivotal sensing lever 21 so that the sensing roller 23 can move up/down. When the paper 1 is pinched between the sensing roller 23 and the conveyance roller 25, the sensing roller 23 is pushed up by a distance corresponding to the thickness of the paper 1. With this displacement of the sensing roller 23, the sensing lever 21 pivots clockwise around the spindle 24 with respect to the drawing as shown in FIG. 3.

A sensing portion 213 such as a reflective surface is provided near the front end portion of the arm portion 212 of the sensing lever 21. A distance L2 between the sensing portion 213 and the spindle 24 is set to be several times as long as a distance L1 between the spindle 231 supporting the sensing roller 23 and the spindle 24. Thus, the displacement of the sensing roller 23 is expressed in an amplified form with a magnification of (L2/L1) in the sensing portion 213. The thus amplified displacement of the sensing portion 213 is sensed by a first displacement sensor 20 made of an optical sensor, a position-sensitive detector (PSD) or the like.

The change of the distance X between the shaft of the sensing roller 23 and the shaft of the conveyance roller 25 due to the insertion of the paper 1, that is, the thickness of the paper 1 can be sensed automatically by the first displacement sensor 20 when the paper 1 is being conveyed. Data about the thickness of the paper 1 obtained by the first displacement sensor 20 are transmitted to a double feed determining unit 38.

The conveyance roller 25 is preferably a rubber roller capable of securing a frictional driving force to convey the paper 1. On the other hand, the conveyance roller 25 has to have moderate hardness to increase the thickness sensing accuracy. Various experimental results showed it is desired to make the hardness of the conveyance roller 25 not lower than 50 degrees (JIS K6301A). Also in a second embodiment which will be described later, it is desired to use a conveyance roller having the same hardness.

Next, the paper 1 is sent to between a conveyance roller 31 and a driven roller 34. The conveyance roller 31 is supported in a fixed position so as to be driven to rotate in the arrow c direction by a not-shown motor (driving unit). The driven roller 34 is pressed to the conveyance roller 31 side by a spring 35 so as to rotate together with the conveyance roller 31 and convey the paper 1 in the arrow a direction.

A bent portion of an L-shaped rigidity sensing lever 33 having a short arm portion 331 and a long arm portion 332 is supported pivotally on a spindle 36 of the conveyance roller 31. The short arm portion 331 is disposed on the conveyance path of the paper 1 so as to project near the exit side of the roller pair of the conveyance roller 31 and the driven roller 34. A spring 32 is connected to the middle of the long arm portion 332 so as to pull the long arm portion 332 in the arrow d direction. A stopper 37 is provided to abut against a part of the rigidity sensing lever 33. Due to the spring 32 and the stopper 37, the rigidity sensing lever 33 is retained in a standby position where the paper 1 cannot arrive.

Near the front end portion of the long arm portion 332, a second displacement sensor 30 is provided. The second displacement sensor 30 is constituted by an optical sensor or a PSD for sensing a displacement of the front end portion of the long arm portion 332.

As shown in FIG. 3, as soon as a front end portion 10 of the paper 1 conveyed projects between the conveyance roller 31 and the driven roller 34, the front end portion 10 abuts against the side surface of the arm portion 331 of the rigidity sensing lever 33. Due to the rigidity of the paper 1, the arm portion 331 sinks against the pulling force of the spring 32.

Due to the balance with the pulling force of the spring 32, the sinking distance is small when the rigidity of the paper 1 is weak, and the sinking distance is large when the rigidity of the paper 1 is strong. Due to so-called nerve of the paper 1, it is desired that the rigidity of the paper 1 is measured in the state where a portion of the paper 1 slightly away from the front end portion 10 is pinched between the conveyance roller 31 and the driven roller 34. Therefore, the arm portion 331 of the rigidity sensing lever 33 is disposed near the exit side of the joint portion of the conveyance roller 31 and the driven roller 34.

As shown in FIG. 2, a distance L4 between the spindle 36 and a sensing portion 333 is set to be longer than a distance L3 between the spindle 36 and the position where the front end portion 10 of the paper 1 running straight from the portion where the conveyance roller 31 and the driven roller 34 are joined, that is, the aforementioned joint portion abuts against the arm portion 331. Thus, the sinking distance of the arm portion 331 is amplified by the magnification of (L4/L3). The displacement of the sensing portion 333, that is, the change of the distance between the sensing portion 333 and the second displacement sensor 30 is sensed by the second displacement sensor 30. Data about the rigidity of the paper 1 obtained by the second displacement sensor 30 are transmitted to the double feed determining unit 38.

Based on the values of thickness and bending rigidity of the paper 1 when the paper 1 includes one sheet and the values of thickness and bending rigidity of the paper 1 when the paper 1 includes two sheets laid on top of each other, the threshold value C and the threshold line D for double feed are set for each kind of paper 1 in advance, and the set data are stored in a storage portion 381 of the double feed determining unit 38.

Output signals from the displacement sensors 20 and 30 are imported to a determination portion 382 of the double feed determining unit 38, while the data of the threshold value C and the threshold line D stored in the storage portion 381 are also imported thereto. The imported data are compared with each other. When the thickness and bending rigidity of the paper 1 sensed by the sensors 20 and 30 correspond to a value larger than the threshold value C and lower than the threshold line D (see FIG. 1), it is determined that the paper 1 is double-fed. When the sensed thickness and bending rigidity correspond to a value smaller than the threshold value C and larger than the threshold line D, it is determined that the paper 1 is single-fed. When the sensed thickness and bending rigidity correspond to a value larger than the threshold value C and larger than the threshold line D, it is determined that the paper is a single sheet having a different thickness from that of the paper 1 conveyed previously. The determination result is sent to a control portion 100 for controlling the device body.

In this manner, units for measuring thickness and bending rigidity of paper are disposed in a conveyance path of the paper, and the measured values of the thickness and bending rigidity measured by these units are compared with a threshold value and a threshold line set in advance. Thus, it is possible to correctly and properly determine whether paper is double-fed or not even if the paper is conveyed for the first time. In addition, it is possible to properly determine whether paper is double-fed or not even if sheets with different thicknesses are mixed in the paper to be conveyed.

Figure 6:
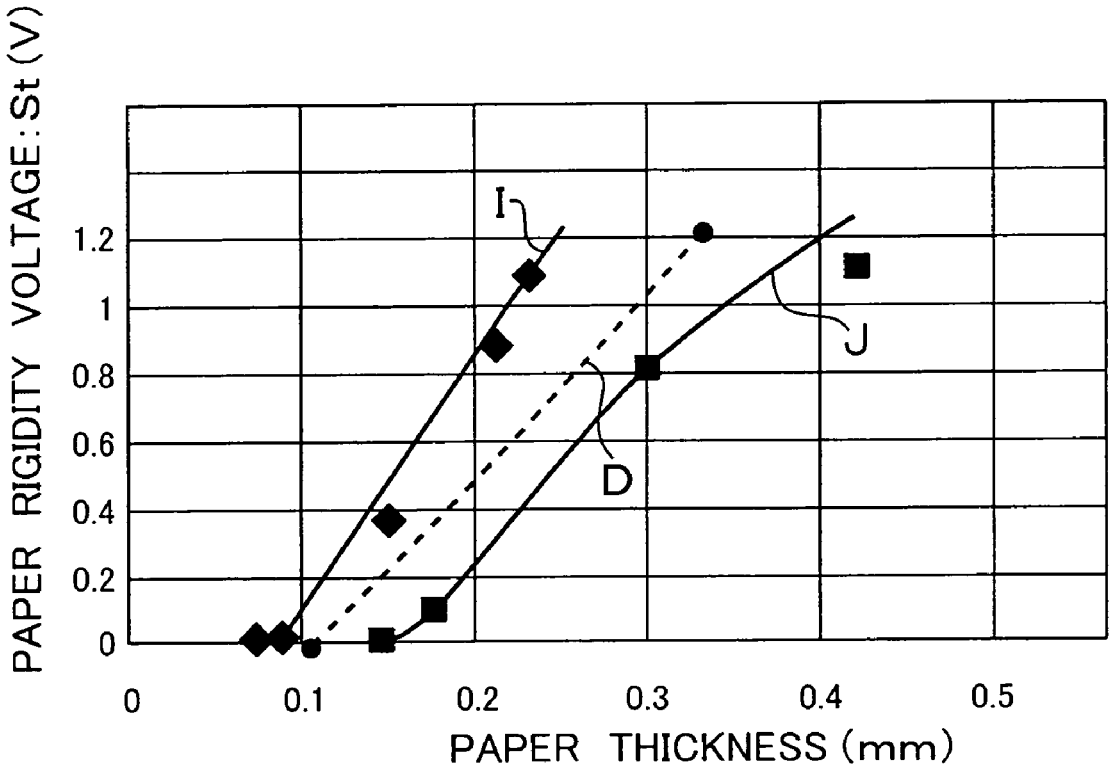
FIG. 6 is a characteristic graph showing a specific example of settings of threshold lines in the embodiments of the present invention.

FIG. 6 is a characteristic graph showing a specific example of setting of the threshold line. In this test, the ratio (L4/L3) of the distance L4 to the distance L3 as shown in FIG. 2, the ratio (L5/L3) of a distance L5 between the spindle 36 and the point to be pulled by the spring 32 to the distance L3 as shown in FIG. 2, and the pulling force F of the spring 32 are set as follows.

$$(L4/L3)=2$$

$$(L5/L3)=1$$

$$F=5N$$

A sensor Z4D-B02 made by OMRON Corporation is used as the second displacement sensor 30. The rigidity of the paper is obtained from a difference between an output voltage Sn of the second displacement sensor when paper is absent and an output voltage Se of the second displacement sensor when paper is present. The paper rigidity voltage St can be expressed by the following expression.

$$St=Se-Sn$$

In FIG. 6, a curve I designates a characteristic curve created by plotting the relationship between the paper thickness and the paper rigidity voltage St of one sheet of paper in tests performed under the aforementioned setting conditions, and a curve J designates a characteristic curve created by plotting the relationship between the paper thickness and the paper rigidity voltage St of two stacked sheets of paper likewise. As is apparent from this graph, the curve I and the curve J are separated from each other without overlapping each other. A line passing through an intermediate position between the two curves I and J is drawn and set as the threshold line D.

When St designates the paper rigidity voltage and Tp designates the paper thickness, the threshold line D can be expressed by the following expression by way of example.

$$St=5.3\times Tp-0.53$$

Accordingly, it is determined that the paper is single-fed when St>5.3×Tp−0.53, and double-fed when St<5.3×Tp−0.53.

Figure 4:
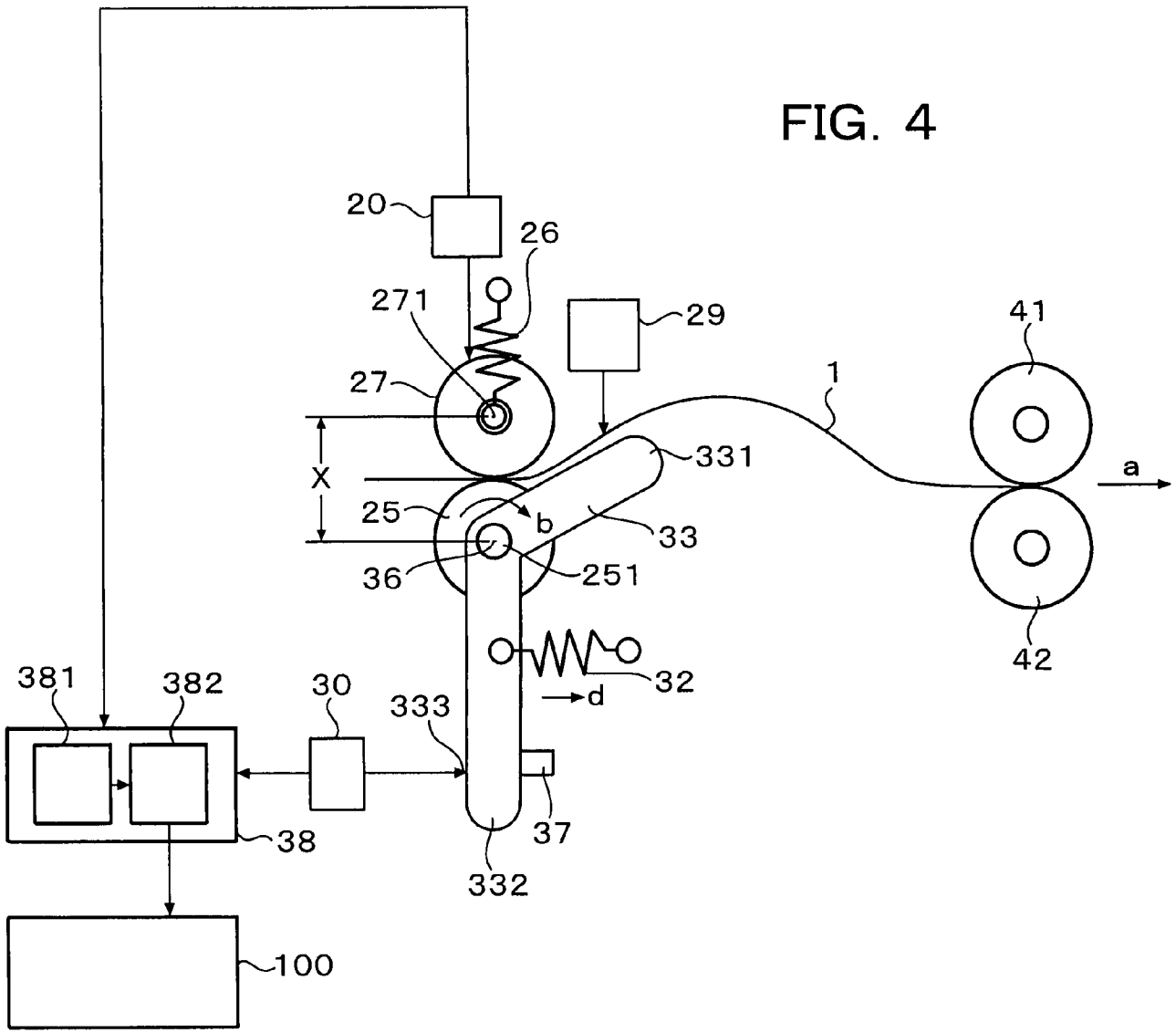
FIG. 4 is a schematic view showing the configuration of a double feed sensing device according to a second embodiment of the present invention.

FIG. 4 is a schematic configuration view of a double feed sensing device according to a second embodiment. In this embodiment, thickness and bending rigidity of paper 1 are sensed substantially concurrently by a single paper conveyance unit.

A thickness sensing roller 27 is supported movably up/down, and pressed onto a conveyance roller 25 by a spring 26. The sensing roller 27 is pushed up by the paper 1 pinched between the conveyance roller 25 and the sensing roller 27. The displacement of a spindle 271 of the thickness sensing roller 27 is sensed by a first displacement sensor 20. Thus, a displacement of a distance X between the spindle 271 of the thickness sensing roller 27 and a rotating shaft 251 of the conveyance roller 25.

A rigidity sensing lever 33 is supported pivotally around a spindle 36 (on the rotation shaft of the conveyance roller 25). A spring 32 pulls the rigidity sensing lever 33 in the arrow d direction, and brings an arm portion 332 of the rigidity sensing lever 33 into abutment against a stopper 37. A second displacement sensor 30 measures a pivotal displacement of the rigidity sensing lever 33 when an arm portion 331 of the rigidity sensing lever 33 is pivoted by the bending rigidity of the paper 1.

In the same manner as in the first embodiment, outputs of the displacement sensors 20 and 30 are input to a double feed determining unit 38, and compared with a threshold value C and a threshold line D. Thus, existence of double feed is determined.

A paper-sensitive sensor 29 for sensing the existence of the paper 1 is disposed on the paper-conveyance-direction downstream side of the rollers 25 and 27. Registration rollers 41 and 42 are disposed on the further downstream side of the paper-sensitive sensor 29. The surface of the registration roller 41 is made of metal, and the surface of the registration roller 42 is formed out of rubber. The registration roller 42 is rotated by a not-shown driving mechanism, so as to convey the paper 1 in the arrow a direction.

In this event, the paper-sensitive sensor 29 senses the front end of the paper 1. In response to a detection signal thereof, the conveyance roller 25 is driven to rotate. Thus, the paper 1 is conveyed by a predetermined distance therefrom. As shown in FIG. 4, this distance is set to press the front end of the paper into a nip portion of the registration rollers 41 and 42 so that the paper 1 can be bent upward to correct the skew. After the skew correction, the registration rollers 41 and 42 convey the paper 1.

In this embodiment, the thickness and bending rigidity of the paper 1 are measured by the roller pair of the conveyance roller 25 and the sensing roller 27 so that double feed is sensed. When the roller pair are disposed just before the registration rollers 41 and 42 for correcting the skew of the paper 1, the double feed sensing unit can be also used as the conveyance unit of the paper 1 for correcting the skew of the paper 1. Thus, the device can be miniaturized.

In the first and second embodiments, the rigidity sensing lever 33 is provided on the spindle of the conveyance roller. However, the rigidity sensing lever 33 does not have to be provided coaxially with the conveyance roller. The rigidity sensing lever 33 may be supported by another spindle than the spindle of the conveyance roller. However, when the rigidity sensing lever 33 is provided on the spindle of the conveyance roller, the structure can be simplified.

Figure 5:
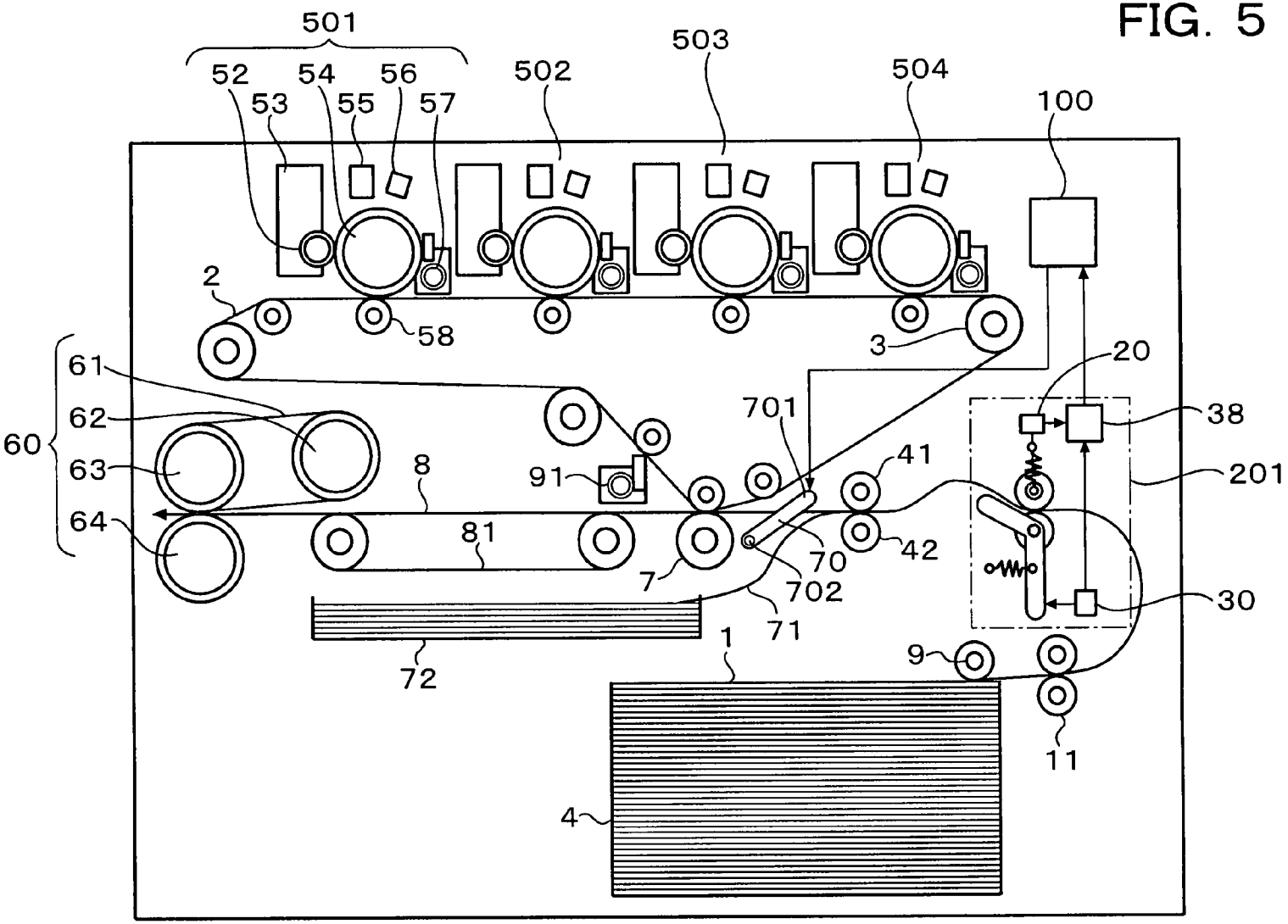
FIG. 5 is a schematic view showing the configuration of an image forming apparatus including the double feed sensing device.

FIG. 5 is a schematic configuration view of an image forming apparatus having the double feed sensing device according to the second embodiment. In the image forming apparatus, four developing units 501-504 are disposed on a transfer belt 2 so as to form a color image with toner on the transfer belt 2. The color image is transferred onto paper 1 sent from a paper stacking unit 4, and fixed by a fixing unit 60. Thus, a color image can be obtained.

The developing units 501-504 store black toner, cyan toner, magenta toner and yellow toner respectively. Each developing unit 501-504 is constituted by a photoconductor drum 54, a charger 55 for charging the surface of the photoconductor drum 54, an exposure unit 56 for writing a latent image on the photoconductor drum 54, a toner hopper 53 for storing toner, a developing roller 52 for forming a toner layer and bring the toner into contact with the photoconductor drum 54, and a drum cleaner 57 for cleaning the surface of the photoconductor drum 54.

The intermediate transfer belt 2 is stretched by a plurality of rollers, and conveyed by a belt driving roller 3. A belt cleaner 91 removes residual toner from the surface of the intermediate transfer belt 2. A primary transfer roller 58 is disposed on the inner side of the intermediate transfer belt 2 so as to face the photoconductor drum 54.

A paper conveyance path 8 runs from the paper stacking unit 4, passes through a pickup roller 9, a separation roller 11, a double feed sensing device 201 and registration rollers 41 and 42, then passes between a secondary transfer roller 7 and the intermediate transfer belt 2, and reaches the fixing unit 60 through a conveyance belt 81.

A lever 701 which can pivot around a spindle 702 is attached onto the paper conveyance path 8 on the downstream side of the double feed sensing device 201 so that the lever 701 can emerge from the conveyance path 8. Under the lever 701, a double-fed paper retraction path 71 branching from the paper conveyance path 8 and a tray-like double-fed paper retraction portion 72 following the double-fed paper retraction path 71 are provided. The lever 701 also serves as a conveyance changeover guide 70.

The fixing unit 60 has a backup roller 64, an elastic roller 63, a heating roller 62 and a fixing belt 61. The fixing belt 61 is stretched between the elastic roller 63 and the heating roller 62, and driven by rotation of the heating roller 62 or another roller. The paper 1 is conveyed while being pressed onto the elastic roller 63 by the backup roller 64. The heating roller 62 has a heating unit such as a halogen heater in a hollow metal shaft, so as to heat the fixing belt 61. The surface of the elastic roller 63 is formed out of an elastic material such as silicon rubber. Pressed by the backup roller 64, a nip portion between the elastic roller 63 and the backup roller 64 projects toward the elastic roller 63 so as to prevent the paper 1 from being wound on the fixing belt 61.

The surface of the photoconductor drum 54 is charged by the charger 55, and irradiated with light in accordance with image information by the exposure unit 56. Thus, an electrostatic latent image is formed on the photoconductor drum 54. The electrostatic latent image reaches the developing roller 52 due to the rotation of the photoconductor drum 54. When the electrostatic latent image abuts against a toner layer thus, charged toner adheres onto the electrostatic latent image.

For example, in the developing unit 501, such a toner image on the photoconductor drum 54 is transferred onto the intermediate transfer belt 2 in the position where the primary transfer roller 58 presses the intermediate transfer belt 2. Subsequently, toner images of cyan, magenta and yellow on the photoconductor drums of the respective developing units are transferred onto the intermediate transfer belt 2 in that order. Thus, a color toner image can be obtained.

Due to the conveyance of the intermediate transfer belt 2, the toner image is transferred onto the conveyed paper 1 in the position of the secondary transfer roller 7. The paper 1 to which the toner image has been transferred is conveyed to the fixing unit 60 through the conveyance belt 81. The toners are fused and fixed by heat and pressure. Thus, a color image is fixed onto the paper 1.

In this example, the intermediate transfer belt 2 is used for transferring a toner image onto the paper 1. However, the intermediate transfer belt 2 is not always required. Toner images may be transferred onto the paper 1 directly from the developing units 501-504 respectively.

Next, description will be made about detection of double feed of the paper 1. The paper 1 is picked up from the paper stacking unit 4 by the pickup roller 9, separated sheet by sheet by the separation roller 11, and conveyed. However, a plurality of sheets put on top of each other may be conveyed without being separated surely. As described previously, the double feed sensing device 201 (the first displacement sensor 20, the second displacement sensor 30 and the double feed determining unit 38) always monitors the state of the paper 1 conveyed. When double feed is detected, a double feed detection signal is sent to a control portion 100 for controlling various operations of the image forming apparatus.

In accordance with the double feed detection signal, the control portion 100 outputs a changeover signal to the conveyance path changeover guide 70. The guide 70 (ever 701) which has stood by in a position away from the paper conveyance path 8 till then is rotated to block the paper conveyance path 8 as illustrated. Thus, the paper is introduced into the double-fed paper retraction path 71, and stocked in the double-fed paper retraction portion 72. As soon as the double-fed paper 1 is guided into the double-fed paper retraction path 71, the guide 70 (lever 701) is returned to the standby position away from the paper conveyance path 8.

When the double-fed paper is retracted automatically in such a manner, the halt of the apparatus caused by paper jam due to double feed can be avoided beforehand. Further, when the double-fed paper is retracted, the apparatus does not have to be suspended to remove the double-fed paper. Accordingly, the operating efficiency of the apparatus is improved so that the printing efficiency is improved, and the burden on the operator can be reduced.

In the aforementioned embodiment, the double feed determining unit 38 and the control portion 100 are provided individually. However, the double feed determining unit 38 may be incorporated in the control portion 100.

The double feed sensing device according to the present invention is applicable not only to a paper conveyance apparatus for printing but also to a paper conveyance apparatus for confirming the number of printed sheets of paper or for sorting printed sheets of paper.

What is claimed is:

1. A double feed sensing device comprising:

a thickness sensing unit for sensing thickness of cut paper conveyed;

a rigidity sensing unit for sensing bending rigidity of the conveyed paper; and a double feed determining unit for comparing a value of the thickness of the paper sensed by the thickness sensing unit and a value of the bending rigidity of the paper sensed by the rigidity sensing unit with threshold values of thickness and rigidity of the paper set based on values of thickness and bending rigidity of one sheet of the paper and values of thickness and bending rigidity of stacked sheets of the paper, so as to determine whether the paper is double-fed or not.

2. A double feed sensing device according to claim 1, wherein the thickness sensing unit includes a driving roller capable of rotating, a driven roller in press contact with the driving roller, and a displacement sensing unit for sensing a displacement of a shaft of the driven roller with respect to a shaft of the driving roller when the paper is held between the driven roller and the driving roller.

3. A double feed sensing device according to claim 2, wherein the displacement sensing unit includes a lever capable of pivoting while supporting the driven roller at one end thereof, and the displacement sensing unit senses the displacement of the shaft of the driven roller with respect to the shaft of the driving roller based on a displacement of the other end of the lever.

4. A double feed sensing device according to claim 3, wherein a distance L1 between a pivoting fulcrum of the lever and a point where the driven roller is supported is shorter than a distance L2 between the pivoting fulcrum of the lever and a sensing portion where the displacement of the other end of the lever is sensed.

5. A double feed sensing device according to claim 1, wherein the rigidity sensing unit includes a sensing member supported so that the sensing member pivots when a front end of the paper abuts against the sensing member, an elastic member for elastically urging a part of the sensing member to appear on a conveyance path of the paper, and a displacement sensing unit for sensing a pivotal displacement of the sensing member when the paper abuts against the part of the sensing member so as to be bent.

6. A double feed sensing device according to claim 5, wherein:

the sensing member has a first arm portion and a second arm portion integrally, the front end of the paper abutting against the first arm portion, the second arm portion having a sensing portion for sensing the pivotal displacement by means of the displacement sensing unit; and a distance L3 between a position where the front end of the paper abuts against the first arm portion and the pivoting fulcrum is shorter than a distance L4 between the sensing portion and the pivoting fulcrum.

7. A double feed determining method comprising the steps of:

using a thickness sensing unit to sense thickness of cut paper which is being conveyed;

using a rigidity sensing unit to sense bending rigidity of the paper which is being conveyed; and using a double feed determining unit to determine double feed of the paper; wherein:

threshold values of the thickness and the bending rigidity of the paper are set based on values of thickness and bending rigidity of one sheet of the paper and values of thickness and bending rigidity of stacked sheets of the paper, and stored in a storage portion of the double feed determining unit; and a value of the thickness of the paper sensed by the thickness sensing unit and a value of the bending rigidity of the paper sensed by the rigidity sensing unit are input to the double feed determining unit and compared with the threshold values respectively so as to determine existence of double feed of the paper.

8. An image forming apparatus comprising:

a photoconductor;

an exposure unit for forming an electrostatic latent image on the photoconductor;

a development unit for forming a toner image on the photoconductor;

a paper stacking portion where cut sheets of paper are stacked;

a conveyance mechanism for sending out the paper from the paper stacking portion toward the photoconductor;

a transfer unit for transferring the toner image on the photoconductor to the paper;

a fixation unit for fixing the transferred toner image to the paper; and a double feed sensing device according to claim 1, provided on a paper-conveyance-direction upstream side of the transfer unit.

9. An image forming apparatus according to claim 8, further comprising a double-fed paper retracting portion for retracting the paper regarded as double-fed by the double feed sensing device.

10. An image forming apparatus comprising:

a photoconductor;

an exposure unit for forming an electrostatic latent image on the photoconductor;

a development unit for forming a toner image on the photoconductor;

a paper stacking portion where cut sheets of paper are stacked;

a conveyance mechanism for sending out the paper from the paper stacking portion toward the photoconductor;

a transfer unit for transferring the toner image on the photoconductor to the paper;

a fixation unit for fixing the transferred toner image to the paper; and a double feed sensing device according to claim 2, provided on a paper-conveyance-direction upstream side of the transfer unit.

11. An image forming apparatus comprising:

a photoconductor;

an exposure unit for forming an electrostatic latent image on the photoconductor;

a development unit for forming a toner image on the photoconductor;

a paper stacking portion where cut sheets of paper are stacked;

a conveyance mechanism for sending out the paper from the paper stacking portion toward the photoconductor;

a transfer unit for transferring the toner image on the photoconductor to the paper;

a fixation unit for fixing the transferred toner image to the paper; and a double feed sensing device according to claim 3, provided on a paper-conveyance-direction upstream side of the transfer unit.

12. An image forming apparatus comprising:

a photoconductor;

an exposure unit for forming an electrostatic latent image on the photoconductor;

a development unit for forming a toner image on the photoconductor;

a paper stacking portion where cut sheets of paper are stacked;

a conveyance mechanism for sending out the paper from the paper stacking portion toward the photoconductor;

a transfer unit for transferring the toner image on the photoconductor to the paper;

a fixation unit for fixing the transferred toner image to the paper; and a double feed sensing device according to claim 4, provided on a paper-conveyance-direction upstream side of the transfer unit.

13. An image forming apparatus comprising:

a photoconductor;

an exposure unit for forming an electrostatic latent image on the photoconductor;

a development unit for forming a toner image on the photoconductor;

a paper stacking portion where cut sheets of paper are stacked;

a conveyance mechanism for sending out the paper from the paper stacking portion toward the photoconductor;

a transfer unit for transferring the toner image on the photoconductor to the paper;

a fixation unit for fixing the transferred toner image to the paper; and a double feed sensing device according to claim 5, provided on a paper-conveyance-direction upstream side of the transfer unit.

14. An image forming apparatus comprising:

a photoconductor;

an exposure unit for forming an electrostatic latent image on the photoconductor;

a development unit for forming a toner image on the photoconductor;

a paper stacking portion where cut sheets of paper are stacked;

a conveyance mechanism for sending out the paper from the paper stacking portion toward the photoconductor;

a transfer unit for transferring the toner image on the photoconductor to the paper;

a fixation unit for fixing the transferred toner image to the paper; and a double feed sensing device according to claim 6, provided on a paper-conveyance-direction upstream side of the transfer unit.

15. A double feed sensing device according to claim 6, wherein:

the rigidity sensing unit includes a driving roller capable of rotating and a driven roller in press contact with the driving roller; and the pivoting fulcrum of the lever is attached to a rotating shaft of the driving roller.

* * * * *